US007909745B2

(12) United States Patent
Mills et al.

(10) Patent No.: US 7,909,745 B2
(45) **Date of Patent: *Mar. 22, 2011**

(54) ADJUSTABLE RESISTANCE EXERCISE DEVICE

(75) Inventors: Stephen Mills, Atkinson, NH (US); Stevenson Tom, Nashua, NH (US)

(73) Assignee: Brookstone Purchasing, Inc., Merrimack, NH (US)

( * ) Notice: Subject to any disclaimer, the term of this patent is extended or adjusted under 35 U.S.C. 154(b) by 37 days.

This patent is subject to a terminal disclaimer.

(21) Appl. No.: 12/369,917

(22) Filed: Feb. 12, 2009

(65) Prior Publication Data

US 2010/0204023 A1 Aug. 12, 2010

(51) Int. Cl.
*A63B 21/04* (2006.01)
*A63B 21/02* (2006.01)
*A63B 21/045* (2006.01)

(52) U.S. Cl. ..... 482/130; 482/126; 482/127

(58) Field of Classification Search ..... 482/55, 482/56, 110, 116, 120, 122, 123, 126, 127, 482/129, 130

See application file for complete search history.

(56) References Cited

U.S. PATENT DOCUMENTS 2,959,414 A 11/1960 Saltz
3,610,617 A 10/1971 Hepburn
3,764,132 A * 10/1973 Hepburn ..... 482/123
4,138,106 A * 2/1979 Bradley ..... 482/5
4,235,439 A 11/1980 De Donno
4,625,961 A 12/1986 Brand
4,944,511 A * 7/1990 Francis ..... 482/123
5,133,545 A * 7/1992 Moschetti et al. ..... 482/115
5,147,265 A 9/1992 Pauls et al.
5,178,596 A 1/1993 McIntire
5,352,176 A 10/1994 Huang
D353,419 S 12/1994 Sprague
D355,458 S 2/1995 Chen
5,492,517 A 2/1996 Bostic et al.
D371,177 S 6/1996 Efobi
5,540,642 A * 7/1996 Sprague ..... 482/123
5,580,338 A 12/1996 Scelta et al.
5,643,153 A 7/1997 Nylen et al.
5,810,698 A 9/1998 Hullett et al.
6,030,321 A * 2/2000 Fuentes ..... 482/83
6,149,559 A 11/2000 Mackey
6,280,366 B1 8/2001 Hsieh
4,403,773 A1 10/2001 Rich
6,299,569 B1 10/2001 Rich
6,315,701 B1 11/2001 Shifferaw
6,328,677 B1 * 12/2001 Drapeau ..... 482/72
D467,632 S 12/2002 Berns
D482,748 S 11/2003 Flynt
6,659,922 B1 12/2003 Yu (Continued)

OTHER PUBLICATIONS

4 Weeks Makeover kit Instruction Booklet for "Cable Gym".

*Primary Examiner* — Allana Lewin
(74) *Attorney, Agent, or Firm* — Grossman Tucker Perreault & Pfleger, PLLC

(57) ABSTRACT

A resistance exercise device enables resistance training by using one or more retractable cables that provide resistance to the user when the user pulls on the cable(s). The resistance exercise device provides a retraction force to retract the cable (s), which is independent of a resistance force applied to the cable(s). The resistance exercise device may thus allow adjustment of the resistance force without affecting the retraction force.

20 Claims, 11 Drawing Sheets

U.S. PATENT DOCUMENTS

| | | | | |
|---|---|---|---|---|
| 6,685,607 | B1 | 2/2004 | Olson | |
| 6,740,014 | B2 * | 5/2004 | Tsai | 482/115 |
| 6,790,163 | B1 * | 9/2004 | Van De Laarschot et al. | 482/56 |
| D500,101 | S | 12/2004 | Fitzgerald et al. | |
| D505,460 | S | 5/2005 | Dalebout et al. | |
| 6,939,275 | B2 | 9/2005 | Minogue et al. | |
| 7,025,710 | B2 | 4/2006 | Corbalis et al. | |
| 7,025,713 | B2 | 4/2006 | Dalebout et al. | |
| 7,087,001 | B1 | 8/2006 | Ihli | |
| 7,250,021 | B2 * | 7/2007 | Leight | 482/116 |
| D557,757 | S | 12/2007 | Van Straaten | |
| 7,357,757 | B2 | 4/2008 | Brown et al. | |
| 7,364,538 | B2 | 4/2008 | Aucamp | |
| 7,601,107 | B2 * | 10/2009 | Maloy et al. | 482/123 |
| 2003/0013585 | A1 * | 1/2003 | Chen | 482/115 |
| 2003/0153441 | A1 * | 8/2003 | Berns et al. | 482/128 |

* cited by examiner

ADJUSTABLE RESISTANCE EXERCISE DEVICE

TECHNICAL FIELD

The present invention relates to exercise devices and more particularly, to adjustable resistance exercise devices.

BACKGROUND INFORMATION

Physical exercise is widely recognized as an important component of maintaining physical fitness and overall health. One type of physical exercise, often referred to as resistance training, uses the resistance to muscular contraction to build the strength, anaerobic endurance and size of skeletal muscles. Various types of exercise devices have been developed to provide such resistance for use in resistance training.

According to one type of resistance exercise device, a user grabs a handle connected to a cable and an opposing resistance force is applied to the cable to resist the user pulling the cable. Such resistance exercise devices often allow the user to adjust the opposing resistance force that is applied against the cable. In such devices, the resistance force is often the same as the retraction force used to cause the cable to retract into the exercise device. Thus, changing the resistance force also results in a corresponding change in the retraction force used to retract the cable. The higher retraction forces resulting from higher resistance forces may cause an undesirable jerking action when using the exercise device.

BRIEF DESCRIPTION OF THE DRAWINGS

These and other features and advantages will be better understood by reading the following detailed description, taken together with the drawings wherein.

DETAILED DESCRIPTION

In general, a resistance exercise device, consistent with the embodiments disclosed herein, enables resistance training by using one or more retractable cables that provide resistance to the user when the user pulls on the cable(s). The resistance exercise device provides a retraction force to retract the cable (s), which is independent of a resistance force applied to the cable(s). The resistance exercise device may thus allow adjustment of the resistance force without affecting the retraction force. In the exemplary embodiments described and shown, the resistance exercise device includes a portable exercise platform with two independently functioning cables; however, the concept of providing a retraction force independent of a resistance force may be used in other types of resistance exercise devices.

Figure 1:
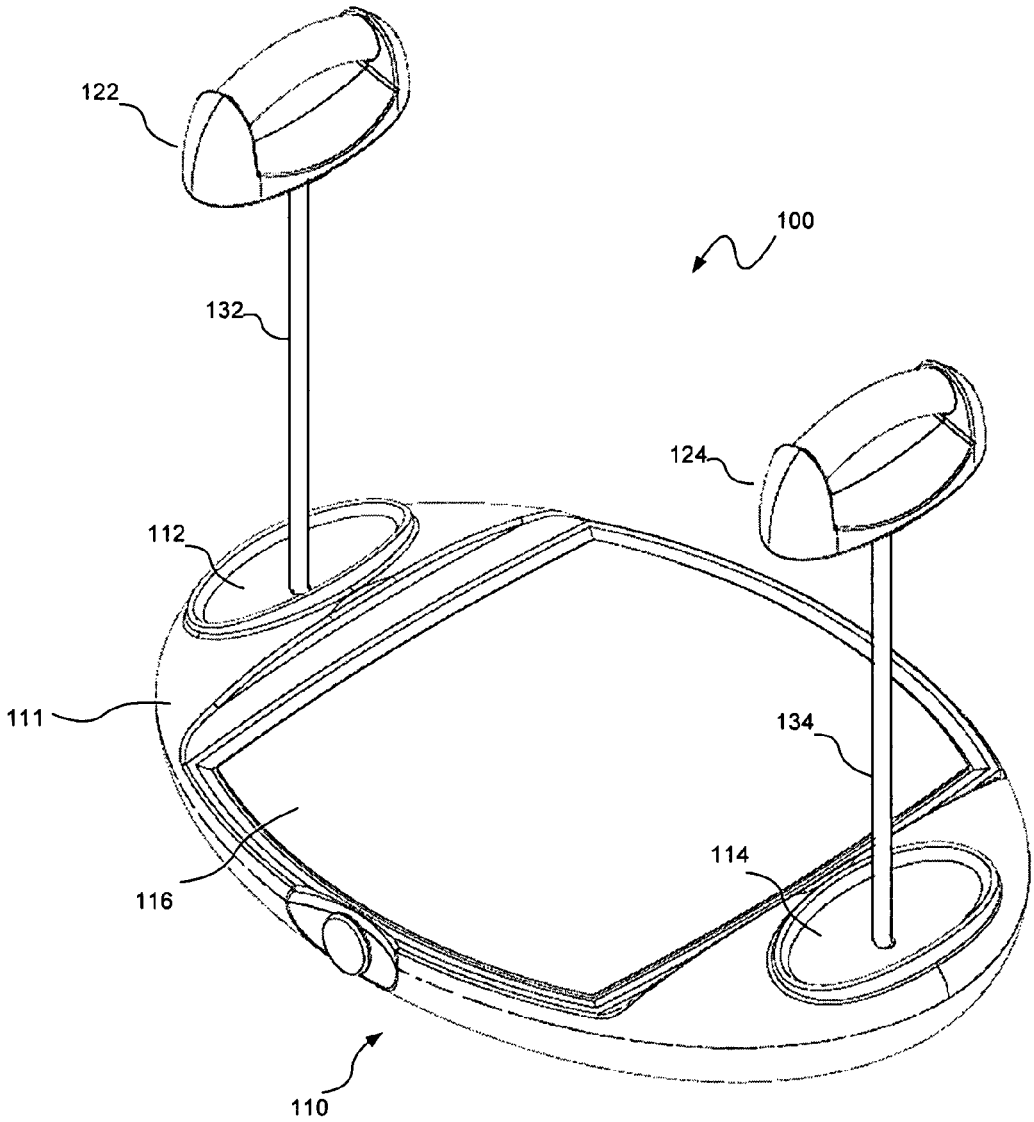
FIG. 1 is a perspective view of an adjustable resistance exercise device, consistent with an embodiment of the present disclosure.

Referring to FIG. 1, an embodiment of an adjustable resistance exercise device 100 generally includes a platform 110 and handles 122, 124 coupled to cables 132, 134 that extend from and retract into the platform 110. The platform 110 may generally include a housing 111 enclosing a resistance and retraction mechanism (not shown) for providing the resistance and retraction forces to the cables 132, 134, as will be described in greater detail below. The platform 110 may also include handle engaging regions 112, 114 that receive the handles 122, 124 and a surface 116, such as a flat surface, that receives a part of the user's body, such as the user's feet, to stabilize the platform 110 as the user grips the handles 122, 124 and pulls the cables 132, 134 from the platform 110. The surface 116 may include a rubber mat and the bottom of the housing 111 may include one or more rubber feet (not shown).

Although the illustrated embodiment has a platform 110 and handles 122, 124 of a particular shape, various other shapes and configurations may be used. In other embodiments, for example, the platform 110 may be shaped or designed to receive other parts of the user's body (e.g., the knees, back, buttocks) and/or the handles 122, 124 may be shaped to be engaged by other parts of the user's body (e.g., the feet). Although the platform 110 is shown as a portable platform, the platform may be integrated in an exercise device that is fixed or the cables 132, 134 may extend from an exercise device without a platform. An exercise device implementing the concepts described herein may also include only one cable and handle or more than two cables and handles.

Figure 2A:
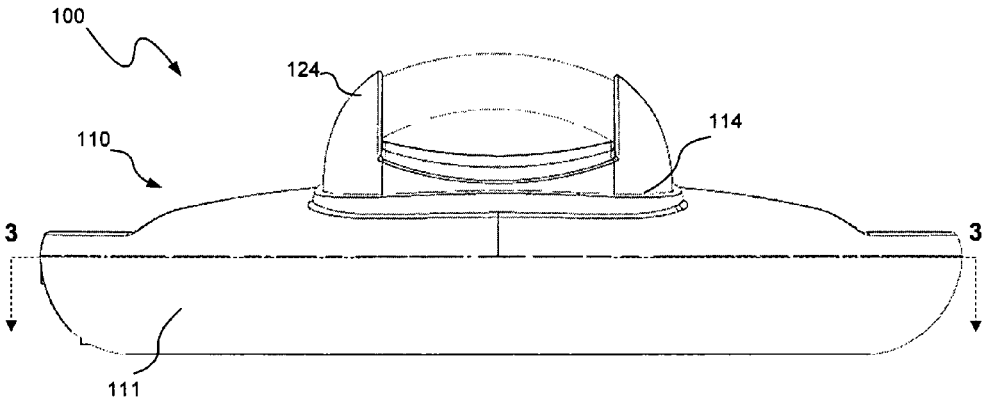
FIGS. 2A and 2B are side views of the adjustable resistance exercise device shown in FIG. 1 with the handles in seated and partially retracted positions, respectively.
Figure 2B:
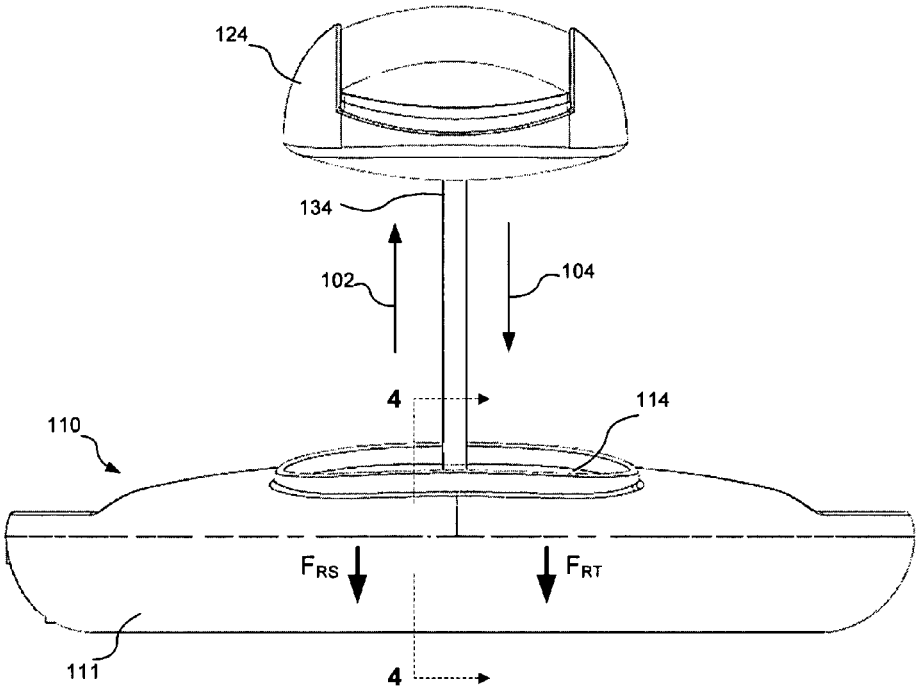

FIGS. 2A and 2B illustrate a handle 124 in a retracted position and partially extended position, respectively. In the retracted position (FIG. 2A), the handle 124 engages the handle engaging region 114. In an embodiment, for example, the handle 124 may be seated in the handle engaging region 114. In an extended position (FIG. 2B), the handle 124 is removed from the handle engaging region 114 and a portion of the cable 134 extends from the platform 110. When the handle 124 is moved from the retracted position to an extended position in the direction of arrow 102, a resistance force $F_{RS}$ is applied to the cable 134 to resist muscular contraction of the user pulling the cable 134 via the handle 124. When the handle 124 is allowed to move to the retracted position in the direction of arrow 104, a retraction force $F_{RT}$ is applied to the cable 134 to cause retraction of the cable 134 into the platform 110. As will be described in greater detail below, the retraction force $F_{RT}$ is applied independently of the resistance force $F_{RS}$ in that the resistance force $F_{RS}$ is not applied when the cable 134 is retracted.

Figure 3:
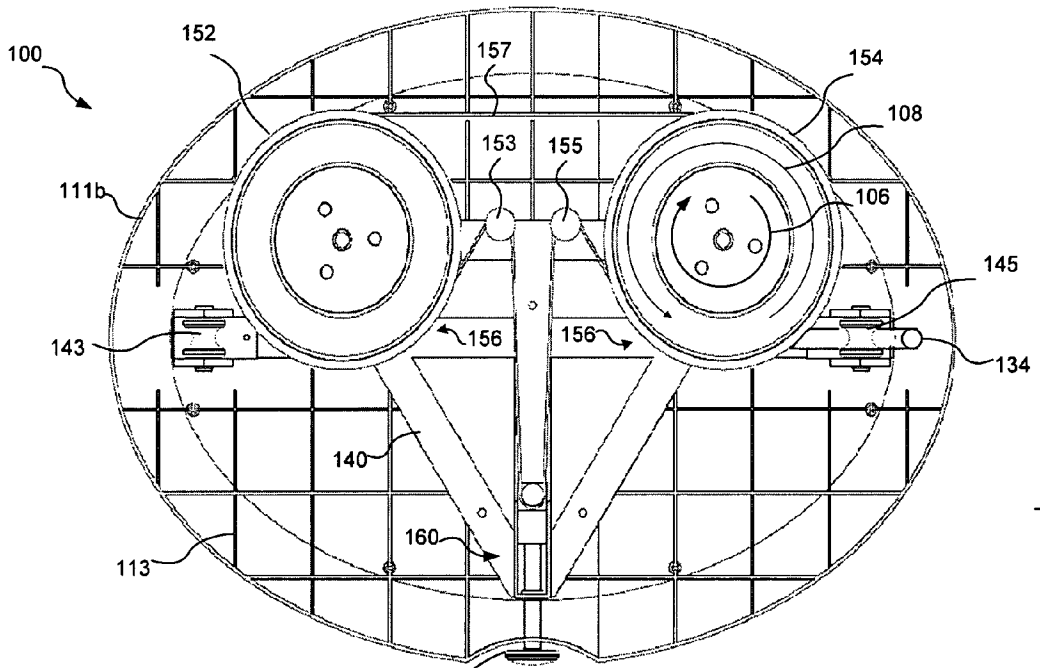
FIG. 3 is a top cross-sectional view of the adjustable resistance exercise device taken along line 3-3 in FIG. 2A.
Figure 4:
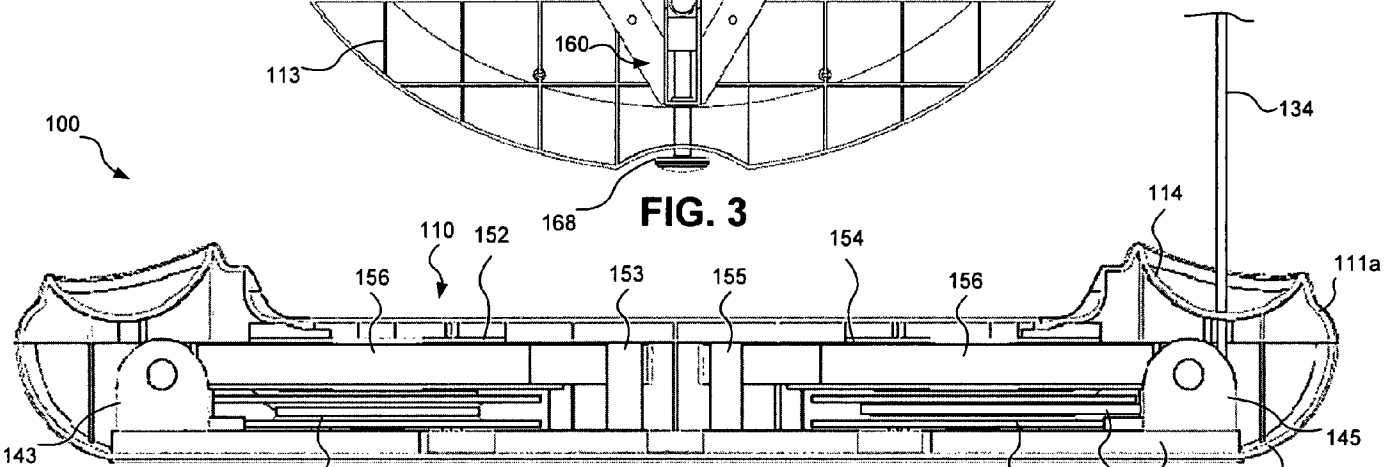
FIG. 4 is a side cross-sectional view of the adjustable resistance exercise device taken along line 4-4 in FIG. 2B.
Figure 5:
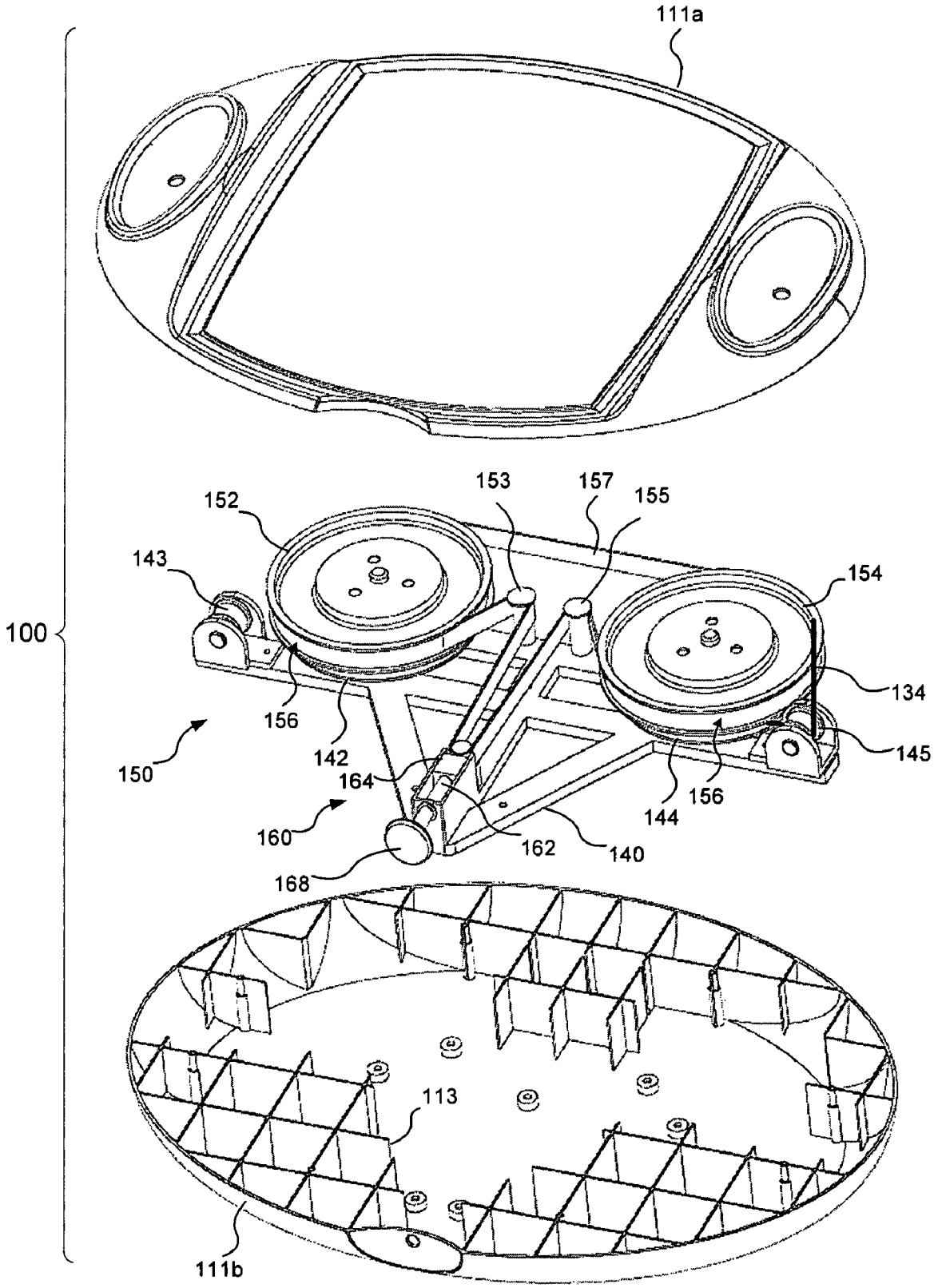
FIG. 5 is an exploded view of the adjustable resistance exercise device shown in FIG. 1.

Referring to FIGS. 3-5, embodiments of a resistance and retraction mechanism that may be used inside of the housing 111 of the platform 110 are described in greater detail. The illustrated embodiment of the exercise device 100 generally includes a support frame 140 and cable receiving spools 142, 144 rotatably coupled to the support frame 140 and coupled to the respective cables 132, 134 (only cable 134 is shown). The cable receiving spools 142, 144 each rotate independently in a winding direction (as indicated by arrow 106) when the respective cable is being retracted and in an unwinding direction (as indicated by arrow 108) when the respective cable is being extended. Pulleys 143, 145 may also be rotatably mounted to the support frame 140 to receive and guide the respective cables 132, 134 to the respective cable receiving spools 142, 144. The pulleys 143, 145 may each have an axis of rotation that is generally orthogonal to an axis of rotation of the respective cable receiving spools 142, 144 such that the spools 142, 144 can lie flat within the housing 111 of the platform 110 with the cables 132, 134 extending generally orthogonally from the platform 110.

The housing 111 of the platform 110 may include first and second housing portions 111*a*, 111*b*. One of the housing portions 111*a* (e.g., an upper housing portion) may include the surface 116 and the handle engaging regions 112, 114. One of the housing portions 111*b* (e.g., a lower housing portion) may be designed to receive and secure the frame 140. One or both of the housing portions 111*a*, 111*b* may include reinforcing structures 113, such as walls, that reinforce the housing 111 to withstand the forces applied to the platform 110 when using the exercise device 100. Although the frame 140 is shown separately from the housing portions 111*a*, 111*b*, the frame 140 may be integrated with or one-piece with the either of the housing portions 111*a*, 111*b*.

The exercise device 100 may include a resistance and retraction mechanism 150 that is operably coupled to the cable receiving spools 142, 144 to apply the resistance forces and to apply the retraction forces independent of the resistance forces. In general, the resistance and retraction mechanism 150 applies the resistance force to resist rotation of the cable receiving spools 142, 144 in the unwinding direction. The resistance force is then transferred to the respective cables 132, 134 to resist extension of the cables 132, 134 toward the extended position when the respective cable receiving spools are rotating in the unwinding direction. The resistance and retraction mechanism 150 applies the retraction force to cause the cable receiving spools 142, 144 to rotate in the winding direction. The retraction force is then transferred to the respective cables 132, 134 to retract the cables toward the retracted position when the respective cable receiving spools are rotating in the winding direction. Thus, the exemplary embodiment of the resistance and retraction mechanism 150 applies the resistance forces only when the respective cable receiving spools 142, 144 are rotating in the unwinding direction. The resistance and retraction mechanism 150 may provide an adjustable resistance force, as described in greater detail below, such that the resistance force may be changed without changing the retraction force.

Figure 6:
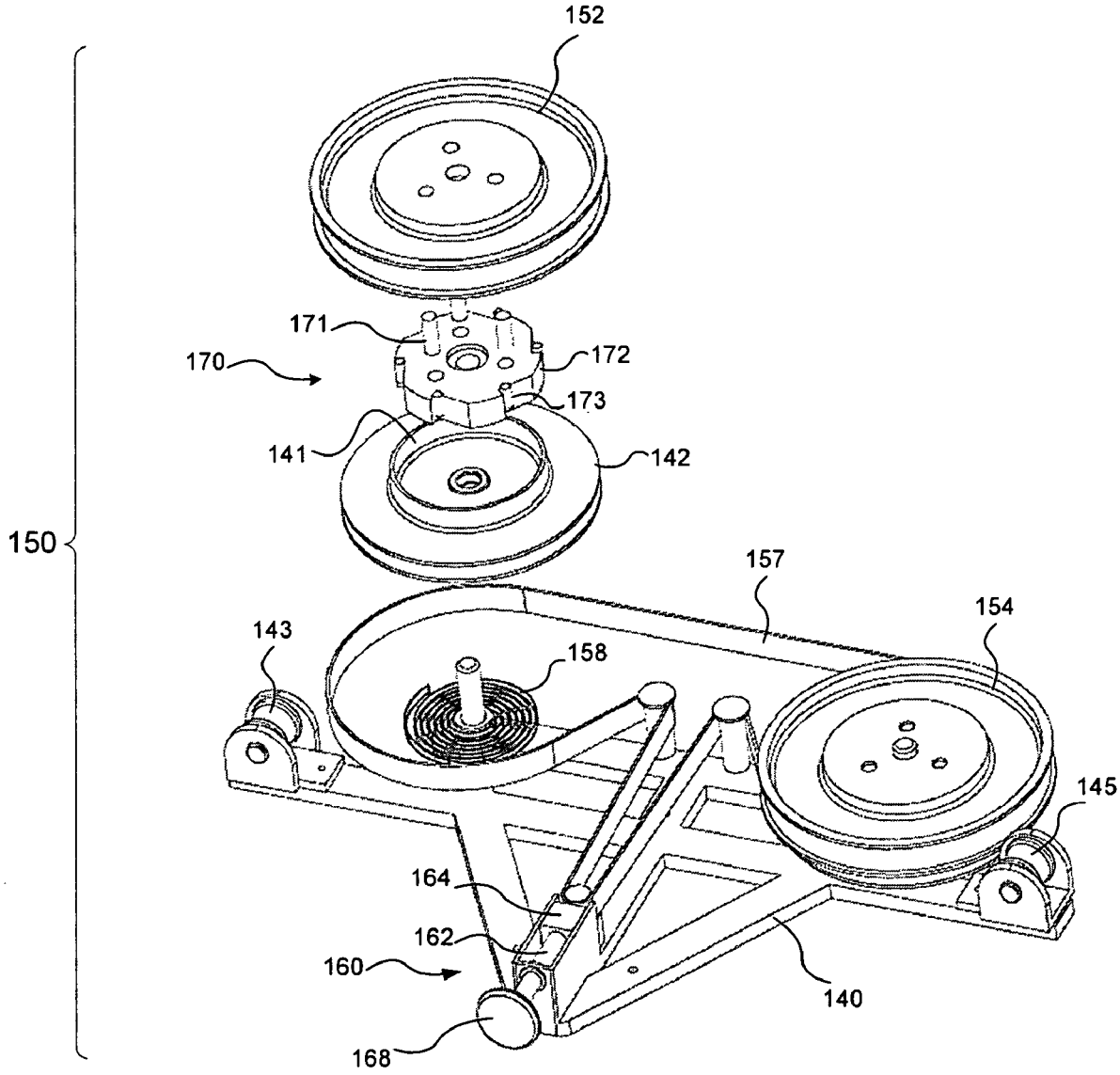
FIG. 6 is an exploded view of one embodiment of the adjustable resistance and retraction mechanism used to provide independent resistance forces and retraction forces on the cables in the adjustable resistance exercise device.

As shown in greater detail in FIGS. 5 and 6, an embodiment of the resistance and retraction mechanism 150 may include resistance wheels 152, 154 rotatably coupled to the support frame 140 and one or more rotation resistance members 156 that engage the resistance wheels 152, 154 to resist rotation of the resistance wheels 152, 154. The resistance wheels 152, 154 may be selectively engaged with the respective cable receiving spools 142, 144 such that the cable receiving spools 142, 144 cause the respective resistance wheels 152, 154 to rotate when the respective cable receiving spools 142, 144 rotate in the unwinding direction (i.e., engaged) and the respective cable receiving spools 142, 144 rotate independently in the winding direction (i.e., disengaged). Thus, resistance forces are applied by the resistance wheels 152, 154 only when the cable receiving spools 142, 144 are rotating in the unwinding direction, as will be described in greater detail below.

In the illustrated embodiment, the rotation resistance member 156 is a resistance belt 157 wrapped around both resistance wheels 152, 154 and engaging at least a portion of an annular surface of the resistance wheels 152, 154. In this embodiment, the resistance force is the friction force that results from rotating the resistance wheels 152, 154 against the resistance belt 157. Guides 153, 155 may be mounted to the frame 140 and may guide the rotation resistance belt 157 around a desired portion of the resistance wheels 152, 154. The amount of surface area of the resistance belt 157 in contact with the annular surface of the resistance wheels 152, 154 (and thus the friction force) depends on the location of the guides 153, 157 relative to the resistance wheels 152, 154. The amount of surface area of the resistance belt 157 in contact with the resistance wheels 152, 154 also affects the adjustability of the resistance force by changing the tension in the resistance belt 157, as described below. As shown in FIG. 3, the guides 153, 155 are located such that the resistance belt 157 contacts between about ½ and ¾ of the circumference of the resistance wheels 152, 154. In one embodiment, the resistance mechanism may be capable of providing a total of 140 lbs. of resistance force (e.g., 70 lbs. on each side).

One example of a resistance mechanism that uses a belt around a wheel is described in greater detail in U.S. Pat. No. 5,643,153, which is incorporated herein by reference. The rotation resistance belt 157 may be made of woven nylon or another suitable material that provides a similar coefficient of friction and that is sufficiently durable when subjected to the friction. The surface area of the resistance belt 157 in contact with the resistance wheels 152, 154 also depends on the width of the resistance belt 157. In one embodiment, the resistance belt 157 may have a width in a range of about ½ inches to 3 inches. The rotation resistance member(s) 156 may also include separate resistance belts wrapped around each of the resistance wheels 152, 154 or may include other friction generating members that contact the resistance wheels 152, 154 to cause a friction force when the resistance wheels are rotated.

The resistance and retraction mechanism 150 may further include a resistance force adjustment mechanism 160 that adjusts the resistance force, for example, by adjusting the friction force generated by the resistance wheels 152, 154 rotating against the resistance member(s) 156. According to the exemplary embodiment, the resistance force adjustment mechanism 160 includes a threaded adjustment rod 162 threadably engaged with a sliding block 164, or similar structure, coupled to the resistance belt 157. Turning the threaded adjustment rod 162 (e.g., using an adjustment knob 168) causes the block 164 to move and changes the tension in the resistance belt 157, which changes the force applied by the resistance belt 157 against the resistance wheels 152, 154 and the resulting friction force. According to one embodiment of the adjustment mechanism 160, a movement of the threaded adjustment rod 162 of about 1 inch allows an adjustment from 5 lbs. to 70 lbs. of resistance force applied by each of the resistance wheels 152, 154. Other resistance force adjusting mechanisms capable of increasing or decreasing the friction force may also be used.

The exemplary embodiment of the resistance and retraction mechanism 150 also includes radial springs 158 (only one is shown in FIG. 6) that engage the cable receiving spools 142, 144 to apply the retraction forces. The radial spring 158 is wound when the respective cable receiving spool 142 are rotated in the unwinding direction by the respective cable 132 moving toward the extended position (i.e., when the user pulls on the cables). When the user stops pulling on the cable 132, the force stored in the wound radial spring 158 provides the retraction force that causes the cable receiving spool 142 to rotate in the winding direction, thereby winding and retracting the cable 132. Other types of springs or resilient members may also be used in the resistance and retraction mechanism 150 to generate the retraction forces. Because the resistance wheel 152 is disengaged from the cable receiving spool 142 during rotation in the winding direction, the radial spring 158 generates the retraction force independent of the resistance force generated by the resistance wheel 152.

Figure 7:
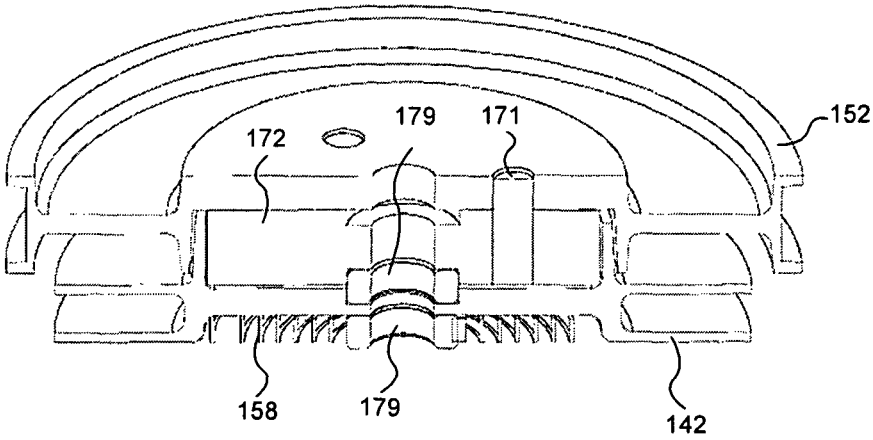
FIG. 7 is a cross-sectional perspective view of a resistance wheel selectively engaged with a cable receiving spool using a locking cam gear mechanism, consistent with an embodiment.
Figure 8:
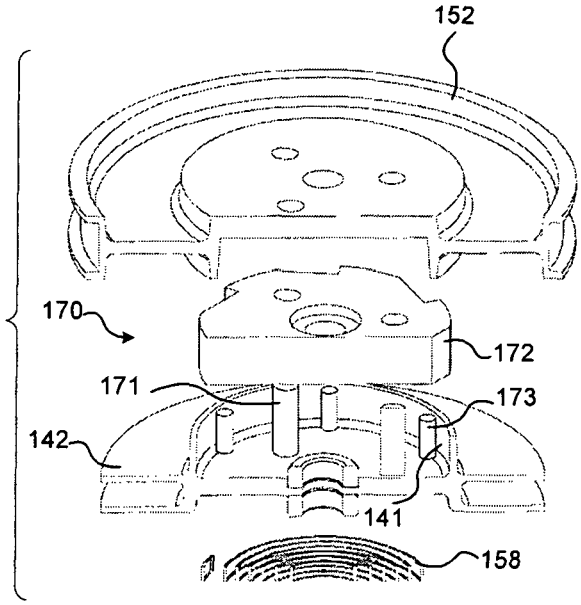
FIG. 8 is an exploded cross-sectional perspective view of the locking cam gear mechanism shown in FIG. 7.
Figure 9:
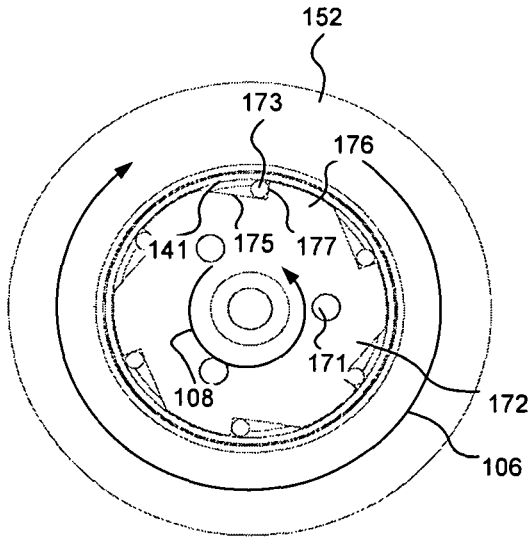
FIG. 9 is a top view of the locking cam gear mechanism shown in FIGS. 7 and 8.

As shown in FIG. 6 and in greater detail in FIGS. 7-9, a locking cam gear mechanism 170 may be used to selectively engage the cable receiving spools 142, 144 and the resistance wheels 152, 154. In the illustrated embodiment, the locking cam gear mechanism 170 is fixedly engaged to the resistance wheel 152, for example, using one or more pins 171, and is selectively engaged to the cable receiving spool 142. For example, the cable receiving spool 142 includes a recessed region formed by an annular surface 141 and the locking cam gear mechanism 170 is received in the recessed region.

An embodiment of the locking cam gear mechanism 170 includes a cam gear 172 and one or more lock bearings 173 that engage the cam gear 172. The cam gear 172 includes one or more cam surfaces 175 and bearing surfaces 177 that form one or more teeth 176. The lock bearings 173 are located between the teeth 176 such that the cam surface(s) 173 engage the lock bearings 173 when the cam gear 172 rotates in one direction (as indicated by arrow 106) and engage the bearing surface(s) 177 when the cam gear 172 rotates in the opposite direction (as indicated by arrow 108). The cam surface 175 forms an acute angle relative to the annular surface 141 such that the lock bearing 173 wedges between the cam surface 175 and the annular surface 141 when rotating in the direction of arrow 106. The bearing surface 177 forms a generally perpendicular angle relative to the annular surface 141 such that the lock bearing 173 rolls against the annular surface 141 when pushed by the bearing surface 177. Thus, the cam gear 172 and the lock bearings 173 lock against the annular surface 141 of the cable receiving spool 142 when rotating in the direction of arrow 106 (i.e., the unwinding direction) and rotate freely with respect to the annular surface 141 when rotating in the direction of arrow 108 (i.e., the winding direction). One or more bearings 179, such as thrust bearings, may be used to facilitate rotation of the cable receiving spool 142 and the locking cam gear mechanism 170.

The locking cam gear 172 may also be fixedly secured to the resistance wheel 152 using other structures or by forming the cam gear 172 as one piece with the resistance wheel 152. In other embodiments, the locking cam gear mechanism 170 may be fixedly engaged to the cable receiving spool 142 and selectively engaged with the resistance wheel 152. Although the lock bearings 173 are shown as rods, they may also be balls or similar structures that will move with the cam gear 172 in one direction of rotation and lock with the cam gear 172 in the other direction of rotation. Further embodiments may use other types of mechanisms, such as ratchet mechanisms, that provide selective engagement in different directions of rotation.

Figure 10:
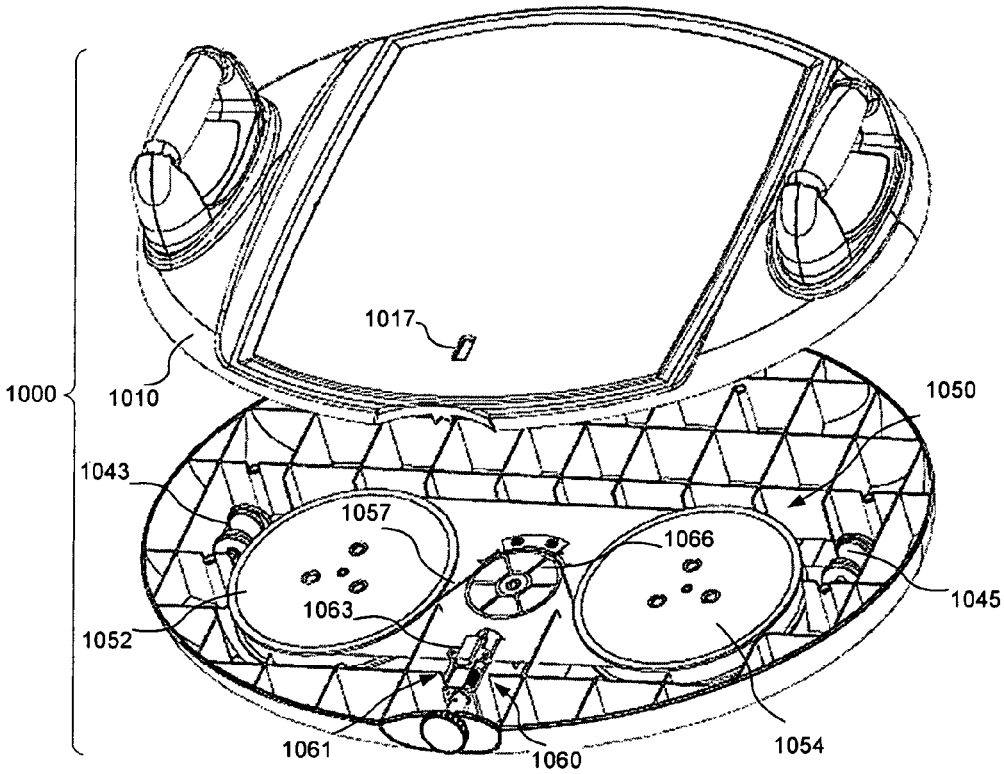
FIG. 10 is an exploded perspective view of another embodiment of the adjustable resistance exercise device.
Figure 11:
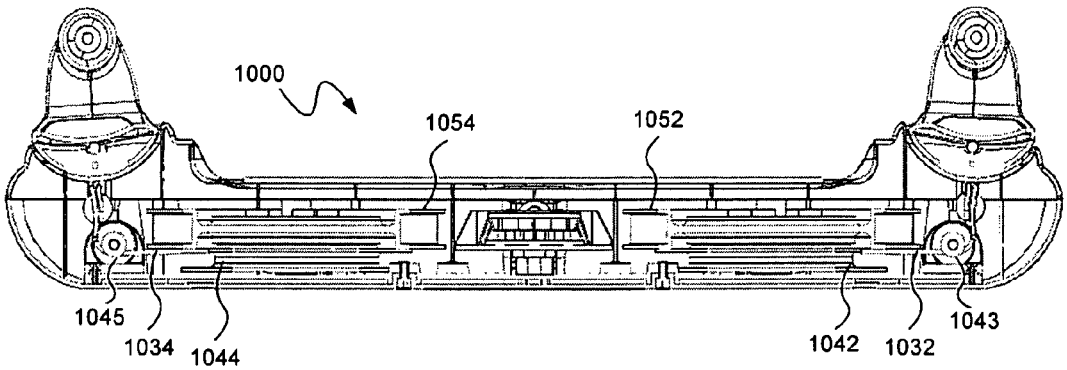
FIG. 11 is a cross-sectional view of the adjustable resistance exercise device shown in FIG. 10.

Referring to FIGS. 10 and 11, another embodiment of an adjustable resistance exercise device 1000 is shown and described. In this embodiment, the adjustable resistance exercise device 1000 includes cable receiving spools 1042, 1044 and a resistance and retraction mechanism 1050 including resistance wheels 1052, 1054 located closer to an adjustment mechanism 1060. The adjustable resistance exercise device 1000 also includes cable pulleys 1043, 1045 that guide cables 1032, 1034 to and from the cable receiving spools 1042, 1044. In this embodiment, the cable receiving spools 1042, 1044 rotate in winding and unwinding directions that are opposite the winding and unwinding directions in the embodiment described above. The cable receiving spools 1042, 1044, pulleys 1043, 1045 and resistance and retraction mechanism 1050 are mounted to a frame 1040 and provided within a platform 1010, for example, as described above.

The adjustment mechanism 1060, according to this embodiment, includes a gauge 1061 that allows a user to gauge the resistance adjustment. The gauge 1061 may be visible through an aperture 1017 in the platform 1010. The gauge 1061 may be calibrated to indicate the approximate resistance (e.g., in pounds) applied to one or both sides of the exercise device 1000.

Figure 12:
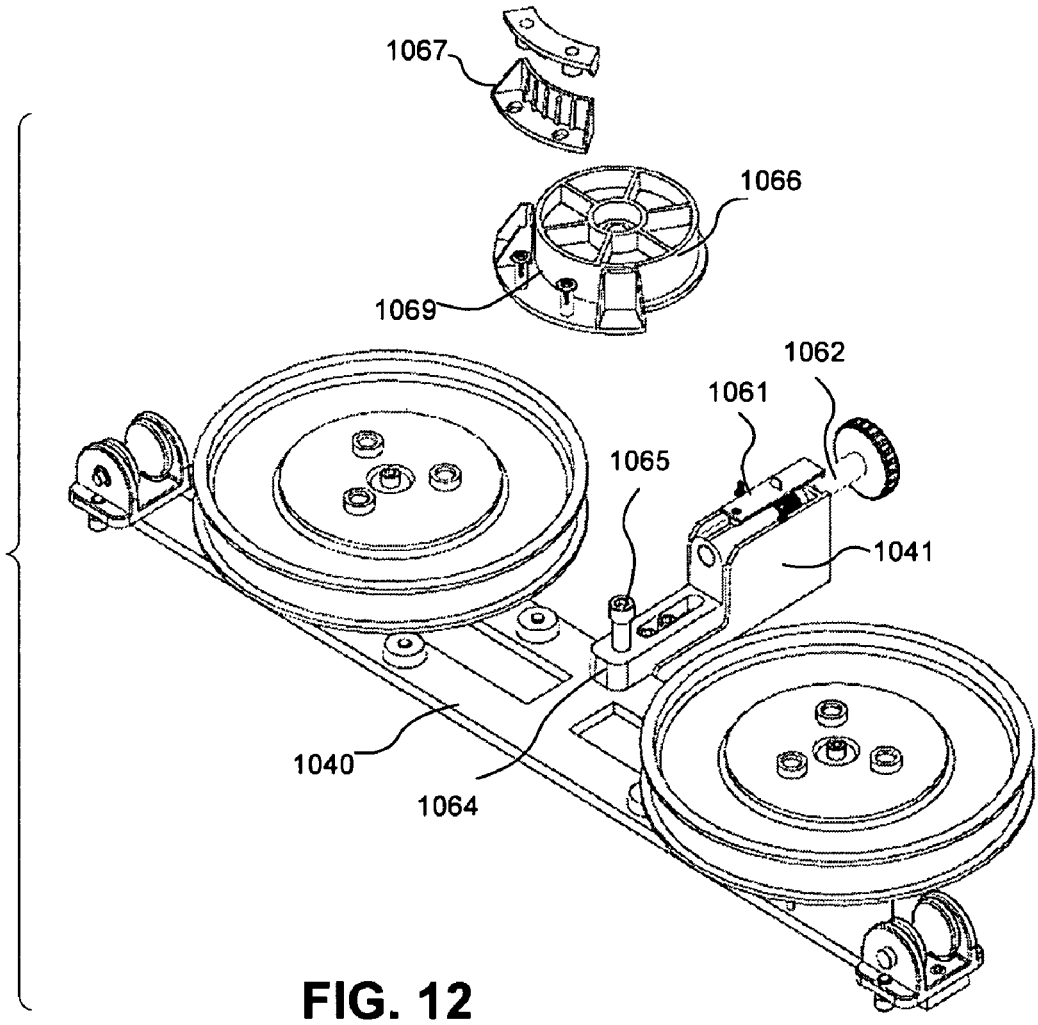
FIG. 12 is an exploded view of another embodiment of an adjustable resistance and retraction mechanism.

As shown in greater detail in FIG. 12, the adjustment mechanism 1060, according to this embodiment, also includes a threaded adjustment rod 1062 that threadably engages a slider 1064, which is coupled to a tensioning wheel 1066 or similar structure. The tensioning wheel 1066 receives a resistance belt 1057 and moves the resistance belt 1057 to adjust the tension thereof and the resistance applied to the resistance wheels 1052, 1054. In this embodiment, the gauge 1061 may include a dial 1063 located in the aperture 1017 of the platform 1010 and a pointer fixed to the slider 1064 and moving relative to the dial 1063. The dial 1063 may include one or more markings or indicia to indicate a relative position of the slider 1064 and thus the relative resistance applied by the resistance belt 1057.

The slider 1064 may be received in a guide portion 1041 extending from the frame 1040, and a bolt 1065 or similar structure may extend from the slider 1064 to engage and move the tensioning wheel 1066. A belt securing member 1067 may secure the resistance belt 1057 against a portion 1069 of the tensioning wheel 1066 to prevent the resistance belt 1057 from sliding when the resistance wheels 1052, 1054 rotate against the resistance belt 1057.

Figure 13:
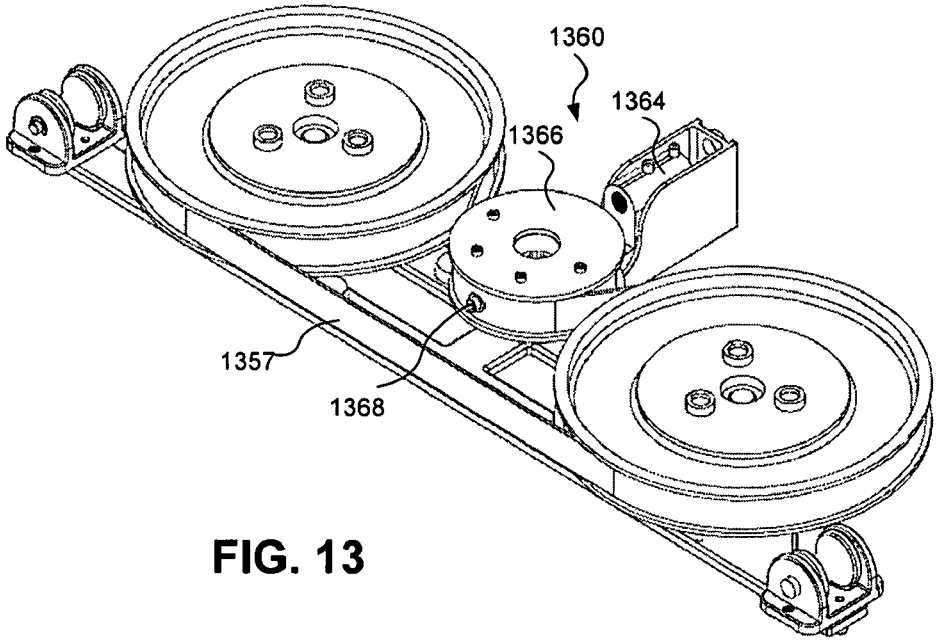
FIG. 13 is a perspective view of the adjustable resistance and retraction mechanism shown in FIG. 12.
Figure 14:
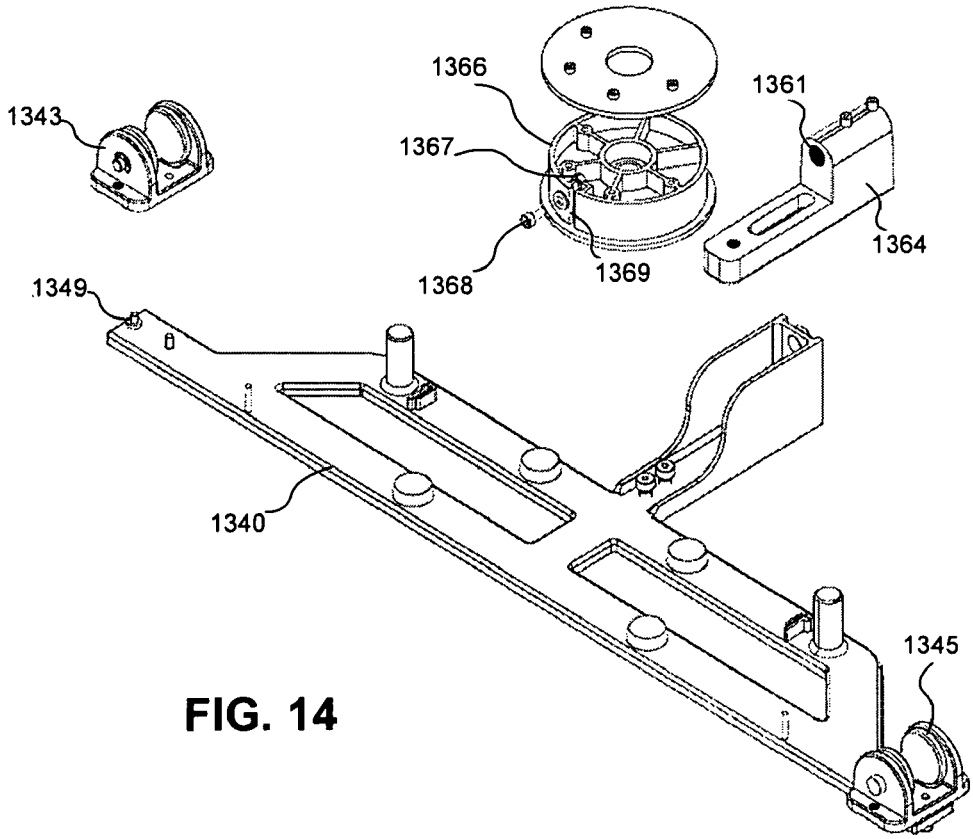
FIG. 14 is an exploded view of an adjustment mechanism in the adjustable resistance and retraction mechanism shown in FIG. 13.
Figure 15:
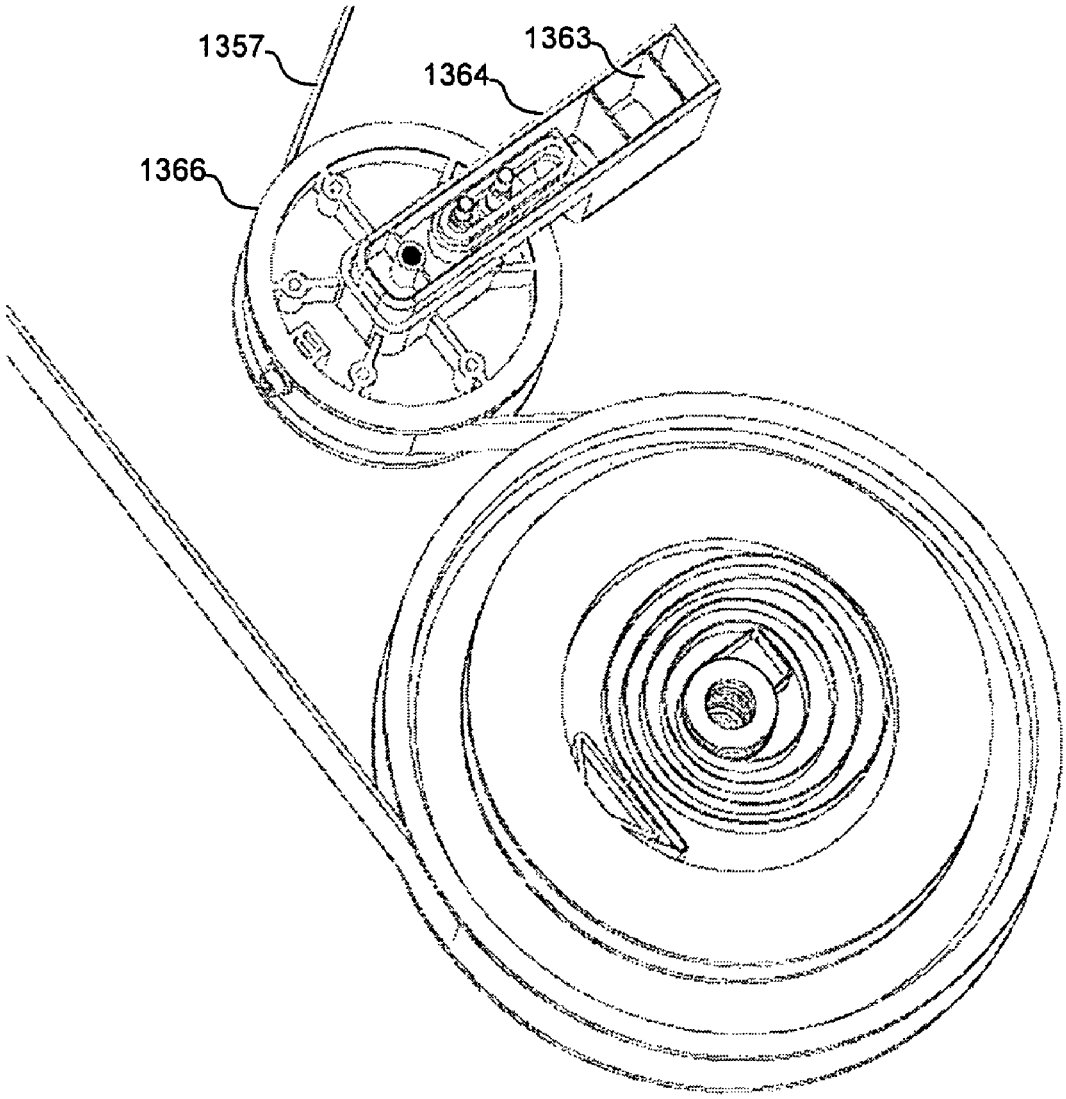
FIG. 15 is a bottom view of the adjustment mechanism in the adjustable resistance and retraction mechanism shown in FIG. 13.

Referring to FIGS. 13-15, a further embodiment of an adjustment mechanism 1360 is described. According to this embodiment, a tension belt 1357 is coupled to a tensioning wheel 1366 or similar structure using hardware such as a nut 1367 and threaded fastener 1368 (e.g., a bolt or socket head cap screw). The nut 1367 is held captive in a slot 1369 in the tensioning wheel 1366 and the threaded fastener 1368 extends through the belt 1357 and into the slot 1369 to threadably engage the nut 1367. The adjustment mechanism 1360 also includes a slider 1364 coupled to the tensioning wheel 1366 as described above (see FIG. 15). The slider 1364 may be made of a plastic material with a steel insert 1361 forming the threaded portion that receives the threaded rod. The slider 1364 may also be hollow with ribs 1363 (FIG. 15) or may be solid. As shown in FIG. 14, the cable pulleys 1343, 1345 may be secured to the frame 1340 using fasteners, such as socket head cap screws, which may pass through the frame 1340 and the bottom of the platform.

Figure 16:
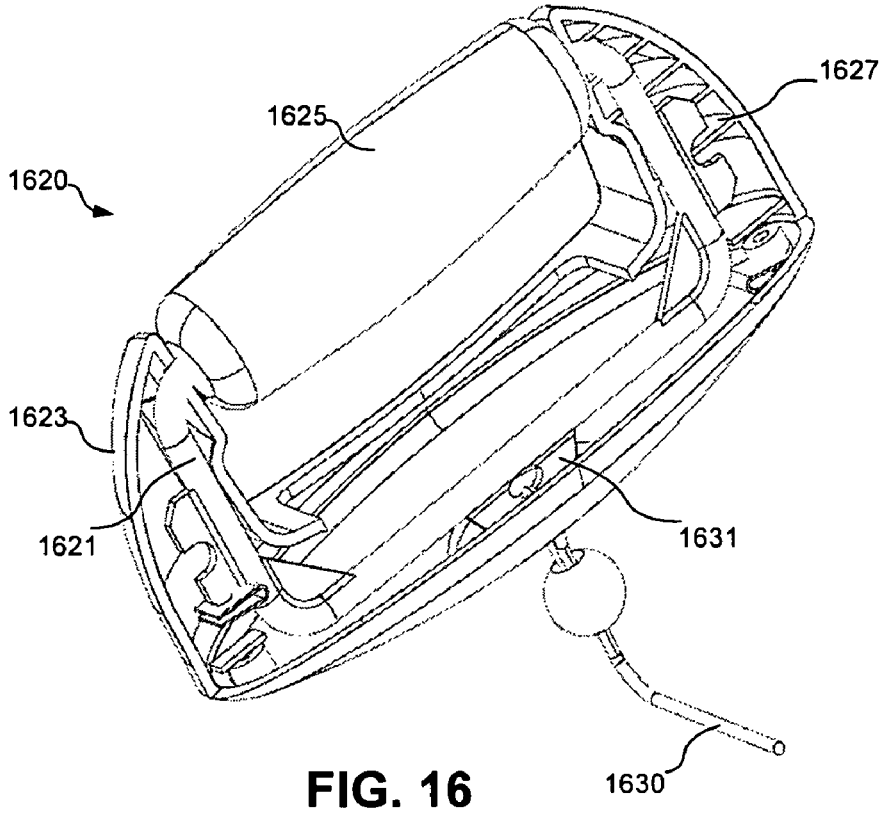
FIG. 16 is a cross-sectional view of an embodiment of a handle that may be used in an adjustable resistance exercise device.
Figure 17:
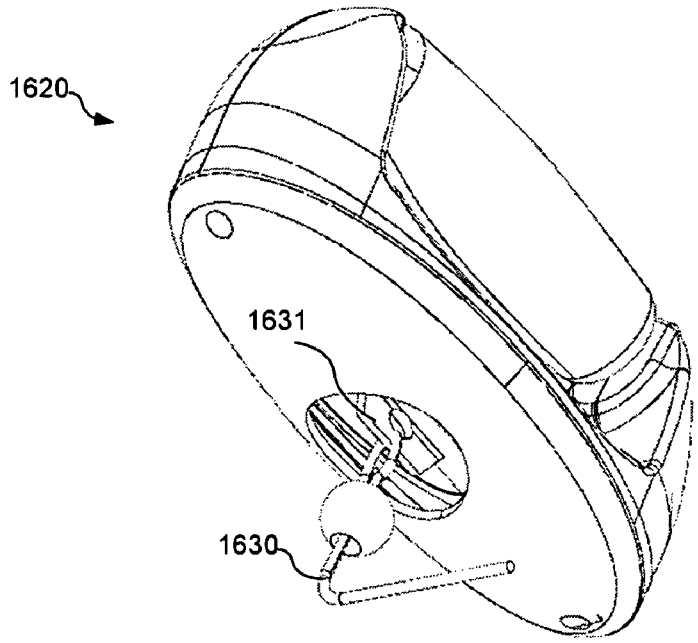
FIG. 17 is a perspective view of the handle shown in FIG. 16.

Referring to FIGS. 16 and 17, one embodiment of a handle 1620 may include a strength member 1621 and a housing 1623 that encloses at least a portion of the strength member 1621. The strength member 1621 is coupled to a cable 1630, for example, through a cable coupling portion 1631 extending through a bottom of the handle 1620. The strength member 1621 may be made of a metal or other suitable material capable of withstanding the forces applied to the handle 1620 during use. The housing 1623 may be made of a plastic or other suitable material and may include ribs 1627 that provide reinforcement. A handle grip 1625 may be rotatably mounted on the strength member 1621 such that the grip 1625 rotates when the user pulls on the handle 1620.

Accordingly, the adjustable exercise device, consistent with the embodiments described herein, uses a resistance and retraction mechanism that provides a retraction force (when retracting a cable) independent of a resistance force (when extending a cable). Thus, the resistance force can be adjusted without changing the retraction force.

Consistent an embodiment, an adjustable resistance exercise device includes a support frame, at least one cable receiving spool rotatably coupled to the support frame, and at least one cable coupled to the cable receiving spool. A length of the cable is coiled around the cable receiving spool in a retracted position and the length of the cable extends from the cable receiving spool in an extended position. The cable receiving spool is rotatable in a winding direction when the cable is being retracted toward the retracted position, and the cable receiving spool is rotatable in an unwinding direction when the cable is being extended toward the extended position. The resistance exercise device also includes at least one adjustable resistance and retraction mechanism operably coupled to the cable receiving spool to apply an adjustable resistance force to the cable receiving spool and to apply a retraction force to the cable receiving spool independent of the adjustable resistance force. The resistance force resists rotation of the cable receiving spool in the unwinding direction to resist extension of the cable toward the extended position when the cable receiving spool is rotating in the unwinding direction. The resistance force is applied only when the cable receiving spool is rotating in the unwinding direction. The retraction force causes the cable receiving spool to rotate in the winding direction to retract the cable toward the retracted position when the cable receiving spool is rotating in the winding direction.

Consistent with another embodiment, a resistance exercise device includes a support frame, at least one resistance wheel rotatably coupled to the support frame, and at least one cable receiving spool rotatably coupled to the support frame and selectively engaged with the resistance wheel such that rotation of the cable receiving spool in an unwinding direction causes the resistance wheel to rotate and rotation of the cable receiving spool in a winding direction is independent of the resistance wheel. The resistance exercise device also includes at least one cable coupled to the cable receiving spool. A length of the cable is coiled around the cable receiving spool in a retracted position and the length of the cable extends from the cable receiving spool in an extended position. The resistance exercise device further includes at least one resistance member engaging the resistance wheel to resist rotation of the resistance wheel in the unwinding direction such that the cable resists extension toward the extended position and at least one retraction spring engaging the cable receiving spool to cause the cable receiving spool to rotate in the winding direction such that the cable retracts toward the retracted position.

Consistent with a further embodiment, an adjustable resistance exercise device includes a support frame, first and second cable receiving spools rotatably coupled to the support frame, and first and second cables coupled to the cable receiving spools, respectively. A length of each of the cables is coiled around the respective cable receiving spools in a retracted position and the lengths of each of the cables extend from the respective cable receiving spools in an extended position. Each of the cable receiving spools is rotatable in a winding direction when the respective cable is being retracted toward the retracted position. Each of the cable receiving spools is rotatable in an unwinding direction when the respective cable is being extended toward the extended position. The exercise device further includes at least one adjustable resistance and retraction mechanism operably coupled to the cable receiving spools to apply adjustable resistance forces to the cables and to apply retraction forces to the cables independent of the adjustable resistance forces.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. An adjustable resistance exercise device comprising a support frame;

at least one cable receiving spool rotatably coupled to the support frame;

at least one cable coupled to the cable receiving spool, wherein a length of the cable is coiled around the cable receiving spool in a retracted position and wherein the length of the cable extends from the cable receiving spool in an extended position, wherein the cable receiving spool is rotatable in a winding direction when the cable is being retracted toward the retracted position, and wherein the cable receiving spool is rotatable in an unwinding direction when the cable is being extended toward the extended position;

at least one adjustable resistance and retraction mechanism operably coupled to the cable receiving spool to apply an adjustable resistance force to the cable receiving spool and to apply a retraction force to the cable receiving spool independent of the adjustable resistance force, wherein the resistance force resists rotation of the cable receiving spool in the unwinding direction to resist extension of the cable toward the extended position when the cable receiving spool is rotating in the unwinding direction, wherein the resistance force is applied only when the cable receiving spool is rotating in the unwinding direction, and wherein the retraction force causes the cable receiving spool to rotate in the winding direction to retract the cable toward the retracted position when the cable receiving spool is rotating in the winding direction; and a housing including a top surface for receiving part of a user, wherein the housing houses the frame, the cable receiving spool, and the adjustable resistance and retraction mechanism, wherein the housing includes an aperture that receives the cable and allows the cable to extend and retract, and wherein the at least one cable receiving spool lies substantially parallel to the top surface of the housing such that an axis of rotation of the cable receiving spool is substantially perpendicular to the top surface of the housing.

2. The adjustable resistance exercise device of claim 1 wherein the housing includes a handle engaging region.

3. The adjustable resistance exercise device of claim 1 further including at least one pulley rotatably mounted to the frame and receiving the cable from the cable receiving spool, wherein an axis of rotation of the pulley is generally orthogonal to an axis of rotation of the cable receiving spool.

4. The adjustable resistance exercise device of claim 1 wherein the adjustable resistance and retraction mechanism comprises:

at least one resistance wheel rotatably coupled to the support frame and selectively engaged with the cable receiving spool such that the cable receiving spool and the resistance wheel are engaged when the cable receiving spool rotates in the unwinding direction and the cable receiving spool and the resistance wheel are disengaged when the cable receiving spool rotates in the winding direction; and at least one rotation resistance member engaging the resistance wheel to resist rotation of the resistance wheel.

5. The adjustable resistance exercise device of claim 4 wherein the adjustable resistance and retraction mechanism further comprises:

a locking cam gear mechanism coupled between the resistance wheel and the cable receiving spool such that the cable receiving spool and the resistance wheel are engaged when the cable receiving spool rotates in the unwinding direction and the cable receiving spool and the resistance wheel are disengaged when the cable receiving spool rotates in the winding direction.

6. The adjustable resistance exercise device of claim 4 wherein the rotation resistance member includes a rotation resistance belt wrapped around at least a portion of the resistance wheel.

7. The adjustable resistance exercise device of claim 6 wherein the adjustable resistance and retraction mechanism further includes a tension adjustment member coupled to the rotation resistance belt for adjusting tension of the rotation resistance belt to adjust the resistance applied to the resistance wheel and the tension on the cable.

8. The adjustable resistance exercise device of claim 1 wherein the adjustable resistance and retraction mechanism includes a spring engaging the cable receiving spool to apply the retraction force, wherein the spring is loaded when the cable receiving spool is rotated in the unwinding direction by the cable moving toward the extended position.

9. The adjustable resistance exercise device of claim 1 further comprising at least one handle coupled to the cable.

10. A resistance exercise device comprising a support frame;

at least one resistance wheel rotatably coupled to the support frame;

at least one cable receiving spool rotatably coupled to the support frame and selectively engaged with the resistance wheel such that rotation of the cable receiving spool in an unwinding direction causes the resistance wheel to rotate and rotation of the cable receiving spool in a winding direction is independent of the resistance wheel;

at least one cable coupled to the cable receiving spool, wherein a length of the cable is coiled around the cable receiving spool in a retracted position and wherein the length of the cable extends from the cable receiving spool in an extended position;

at least one resistance member engaging the resistance wheel to resist rotation of the resistance wheel in the unwinding direction such that the cable resists extension toward the extended position; and at least one retraction spring engaging the cable receiving spool to cause the cable receiving spool to rotate in the winding direction such that the cable retracts toward the retracted position; and a housing including a top surface for receiving part of a user, wherein the housing houses the frame, the resistance wheel, the cable receiving spool, the resistance member, and the retraction spring, wherein the housing includes an aperture that receives the cable and allows the cable to extend and retract, and wherein the at least one cable receiving spool substantially parallel to the top surface of the housing such that an axis of rotation of the cable receiving spool is substantially perpendicular to the top surface of the housing.

11. The resistance exercise device of claim 10 wherein the resistance member includes a rotation resistance belt wrapped around at least a portion of the resistance wheel.

12. The resistance exercise device of claim 11 further comprising a tension adjustment member coupled to the rotation resistance belt for adjusting tension of the rotation resistance belt to adjust the resistance applied to the resistance wheel and the tension on the cable.

13. The resistance exercise device of claim 10 further comprising:

a locking cam gear mechanism coupled between the resistance wheel and the cable receiving spool such that the cable receiving spool and the resistance wheel are engaged when the cable receiving spool rotates in the unwinding direction and the cable receiving spool and the resistance wheel are disengaged when the cable receiving spool rotates in the winding direction.

14. The resistance exercise device of claim 10 further comprising at least one handle coupled to the cable.

15. An adjustable resistance exercise device comprising a support frame;

first and second cable receiving spools rotatably coupled to the support frame;

first and second cables coupled to the cable receiving spools, respectively, wherein a length of each of the cables is coiled around the respective cable receiving spools in a retracted position and wherein the lengths of each of the cables extend from the respective cable receiving spools in an extended position, wherein each of the cable receiving spools is rotatable in a winding direction when the respective cable is being retracted toward the retracted position, and wherein each of the cable receiving spools is rotatable in an unwinding direction when the respective cable is being extended toward the extended position;

at least one adjustable resistance and retraction mechanism operably coupled to the cable receiving spools to apply adjustable resistance forces to the cables and to apply retraction forces to the cables independent of the adjustable resistance forces; and wherein the adjustable resistance mechanism comprises:

first and second resistance wheels rotatably coupled to the support frame and selectively engaged with the respective first and second cable receiving spools such that the cable receiving spools and the resistance wheels are engaged when the respective cable receiving spools rotate in the unwinding direction and the cable receiving spools and the resistance wheels are disengaged when the respective cable receiving spools rotate in the winding direction;

at least one rotation resistance member engaging the first and second resistance wheels, respectively, to resist rotation of the resistance wheels; and first and second locking cam gear mechanisms coupled between the resistance wheels and the cable receiving spools, respectively, such that the cable receiving spools and the resistance wheels are engaged when the respective cable receiving spools rotate in the unwinding direction and the cable receiving spools and the resistance wheels are disengaged when the respective cable receiving spools rotate in the winding direction.

16. The adjustable resistance exercise device of claim 15 wherein the adjustable resistance and retraction mechanism applies the resistance forces to resist rotation of the respective cable receiving spools in the unwinding direction to resist extension of the respective cables toward the extended position when the respective cable receiving spools are rotating in the unwinding direction, wherein the resistance forces are applied only when the respective cable receiving spools are rotating in the unwinding direction, and wherein the adjustable resistance and retraction mechanism applies the retraction forces to cause the respective cable receiving spools to rotate in the winding direction to retract the respective cables toward the retracted position when the respective cable receiving spools are rotating in the winding direction.

17. The adjustable resistance exercise device of claim 15 further comprising a housing including a top surface for receiving part of a user, wherein the housing houses the frame, the cable receiving spools, and the adjustable resistance and retraction mechanism, wherein the housing includes apertures that receive the cables and allows the cables to extend and retract, and wherein the housing includes handle engaging regions.

18. The adjustable resistance exercise device of claim 15 further comprising first and second pulleys rotatably mounted to the frame and receiving the respective first and second cables from the respective first and second cable receiving spools, wherein an axis of rotation of each of the pulleys is generally orthogonal to an axis of rotation of each of the respective cable receiving spools.

19. The adjustable resistance exercise device of claim 15 wherein the adjustable resistance and retraction mechanism includes first and second springs engaging the respective first and second cable receiving spools to apply the retraction force, wherein the springs are loaded when the respective cable receiving spools are rotated in the unwinding direction by the respective cables moving toward the extended position.

20. The adjustable resistance exercise device of claim 15 further comprising a tension adjustment member coupled to the at least one rotation resistance belt for adjusting tension of the at least rotation resistance member to adjust the resistance applied to both of the resistance wheels and the tension on both of the cables.

* * * * *